US012667194B2

(12) United States Patent
Slongo et al.

(10) Patent No.: US 12,667,194 B2
(45) Date of Patent: Jun. 30, 2026

(54) MOTION MECHANISM FOR A CHAIR AND CHAIR

(71) Applicant: L&P PROPERTY MANAGEMENT COMPANY, South Gate, CA (US)

(72) Inventors: Alessandro Slongo, Mogliano Veneto (IT); Nigel Charles Fitzsimmonds, Edlingham (GB)

(73) Assignee: L&P PROPERTY MANAGEMENT COMPANY, Carthage, MO (US)

( * ) Notice: Subject to any disclaimer, the term of this patent is extended or adjusted under 35 U.S.C. 154(b) by 183 days.

(21) Appl. No.: 18/573,349

(22) PCT Filed: May 5, 2022

(86) PCT No.: PCT/EP2022/062164
§ 371 (c)(1),
(2) Date: Dec. 21, 2023

(87) PCT Pub. No.: WO2022/268394
PCT Pub. Date: Dec. 29, 2022

(65) Prior Publication Data

US 2024/0365983 A1 Nov. 7, 2024

(30) Foreign Application Priority Data

Jun. 23, 2021 (EP) ..... 21181234

(51) Int. Cl.
*A47C 1/032* (2006.01)
*A47C 1/033* (2006.01)
(Continued)

(52) U.S. Cl.
CPC ..... *A47C 3/0252* (2013.01); *A47C 1/032* (2013.01); *A47C 1/03255* (2013.01);
(Continued)

(58) Field of Classification Search
CPC ..... A47C 1/032; A47C 1/03255; A47C 7/006; A47C 7/024; A47C 7/14; A47C 7/40;
(Continued)

(56) References Cited

U.S. PATENT DOCUMENTS 3,080,195 A 3/1963 Berg
3,550,953 A 12/1970 Neale
(Continued)

FOREIGN PATENT DOCUMENTS

CA 2882241 A1 2/2014
CA 2868902 A1 4/2016
(Continued)

OTHER PUBLICATIONS

European Search Report and Search Opinion received for European Application No. 21181234.2, mailed on Nov. 30, 2021, 7 pages.
(Continued)

*Primary Examiner* — Rodney B White
(74) *Attorney, Agent, or Firm* — Shook, Hardy & Bacon L.L.P.

(57) ABSTRACT

A motion mechanism for a chair effects a coordinated movement of a chair seat and chair back. The motion mechanism comprises a mechanism configured to support the chair seat and to couple the chair seat to a chair base assembly, a first back support configured to couple the chair back to the mechanism, and a second back support configured to couple the chair back to the mechanism. A first end of the first back support and a first end of the second back support are coupled via rotary connections to the mechanism. A second end of the first back support and a second end of the second back support are configured for coupling to the chair back. An axis of rotation of the first rotary
(Continued)

connection extends in a front-rear direction of the chair and an axis of rotation of the second rotary connection extends in the front-rear direction.

13 Claims, 15 Drawing Sheets

(51) Int. Cl.

| | |
|---|---|
| ***A47C 3/021*** | (2006.01) |
| ***A47C 3/025*** | (2006.01) |
| ***A47C 3/026*** | (2006.01) |
| ***A47C 3/03*** | (2006.01) |
| ***A47C 7/02*** | (2006.01) |
| ***A47C 7/14*** | (2006.01) |
| ***A47C 7/40*** | (2006.01) |
| ***A47C 7/44*** | (2006.01) |
| *A47C 7/00* | (2006.01) |

(52) U.S. Cl.
CPC ..... *A47C 3/026* (2013.01); *A47C 3/03* (2013.01); *A47C 7/14* (2013.01); *A47C 7/40* (2013.01); *A47C 7/444* (2018.08); *A47C 7/448* (2013.01); *A47C 7/004* (2013.01); *A47C 7/006* (2013.01)

(58) Field of Classification Search
CPC ..... A47C 7/444; A47C 7/448; A47C 3/0252; A47C 3/026; A47C 3/03
See application file for complete search history.

(56) References Cited

U.S. PATENT DOCUMENTS

| | | | | |
|---|---|---|---|---|
| 3,934,930 | A * | 1/1976 | Sandham | A47C 7/445 297/291 X |
| 4,641,885 | A * | 2/1987 | Brauning | A47C 1/03255 297/292 X |
| 5,048,893 | A | 9/1991 | Cowan et al. | |
| 5,113,851 | A | 5/1992 | Gamba | |
| 6,116,687 | A * | 9/2000 | Vogtherr | A47C 7/448 297/291 X |
| 6,623,078 | B2 | 9/2003 | Chu et al. | |
| 6,672,669 | B2 | 1/2004 | Chu et al. | |
| 6,820,935 | B1 * | 11/2004 | Cioncada | A47C 1/03272 297/320 |
| 7,278,688 | B1 * | 10/2007 | Hung | A47C 7/448 297/285 |
| 7,396,080 | B2 | 7/2008 | Suhr et al. | |
| 7,416,251 | B2 * | 8/2008 | Chu | A47C 7/448 297/285 |
| 7,427,107 | B2 * | 9/2008 | Yang | A47C 7/405 297/291 X |
| 7,490,901 | B2 * | 2/2009 | Maier | A47C 7/448 297/291 |
| 7,637,570 | B2 | 12/2009 | Becker et al. | |
| D609,482 | S | 2/2010 | Englisch et al. | |
| 7,712,833 | B2 * | 5/2010 | Ueda | A47C 7/4454 297/296 X |
| 7,717,513 | B2 | 5/2010 | Ueda | |
| 7,862,120 | B2 | 1/2011 | Ueda | |
| 8,070,232 | B2 * | 12/2011 | Hung | A61G 5/12 297/301.1 |
| 8,696,064 | B2 * | 4/2014 | Pan | A47C 7/443 297/285 |
| 9,504,330 | B2 | 11/2016 | Gehner et al. | |
| 9,585,484 | B1 * | 3/2017 | Tsai | A47C 7/40 |
| 10,058,180 | B2 * | 8/2018 | Desanta | A47C 1/03255 |
| 10,182,953 | B2 * | 1/2019 | Tsuber | A61G 5/1067 |
| 10,945,529 | B2 | 3/2021 | O'boyle et al. | |
| 11,944,208 | B2 * | 4/2024 | Snyder | A47C 3/04 |
| 2007/0108818 | A1 * | 5/2007 | Ueda | A47C 7/445 297/285 |
| 2007/0108819 | A1 * | 5/2007 | Ueda | A47C 7/443 297/292 |
| 2007/0108822 | A1 * | 5/2007 | Ueda | A47C 1/03261 297/301.6 |
| 2010/0301652 | A1 * | 12/2010 | Ballendat | A47C 7/405 297/285 |
| 2012/0256458 | A1 | 10/2012 | Gehner et al. | |
| 2015/0245713 | A1 | 9/2015 | Desanta | |
| 2016/0235203 | A1 | 8/2016 | Rechtien et al. | |
| 2017/0035201 | A1 | 2/2017 | Sander et al. | |
| 2017/0231391 | A1 | 8/2017 | Desanta et al. | |
| 2018/0184809 | A1 | 7/2018 | Bock et al. | |
| 2018/0213939 | A1 | 8/2018 | Schmidt et al. | |
| 2019/0021500 | A1 | 1/2019 | Sander et al. | |
| 2019/0380497 | A1 | 12/2019 | Costaglia | |
| 2025/0098863 | A1 * | 3/2025 | Hervol | A47C 9/002 |

FOREIGN PATENT DOCUMENTS

| | | | |
|---|---|---|---|
| DE | 1 779 707 | A1 | 9/1971 |
| DE | 94 00 040 | U1 | 6/1994 |
| DE | 29 516 794 | U1 | 12/1995 |
| DE | 299 08 599 | U1 | 8/1999 |
| DE | 102 45 774 | A1 | 7/2003 |
| DE | 20 2006 013 748 | U1 | 11/2006 |
| DE | 10 2005 042 811 | A1 | 3/2007 |
| DE | 20 2007 007 524 | U1 | 10/2008 |
| DE | 10 2007 042 032 | B3 | 2/2009 |
| DE | 10 2011 051 966 | A1 | 1/2013 |
| DE | 10 2011 088 249 | A1 | 6/2013 |
| DE | 10 2012 219 157 | A1 | 5/2014 |
| DE | 20 2014 101 592 | U1 | 6/2014 |
| DE | 10 2014 006 558 | B3 | 4/2015 |
| DE | 10 2014 103 780 | B3 | 6/2015 |
| EP | 1 051 931 | A1 | 11/2000 |
| EP | 2 486 826 | A1 | 8/2012 |
| EP | 2 764 798 | A1 | 8/2014 |
| EP | 3 108 768 | A1 | 12/2016 |
| EP | 3 581 066 | A1 | 12/2019 |
| EP | 3 653 082 | A1 | 5/2020 |
| GB | 2565537 | B | 8/2019 |
| PL | 230249 | B1 | 10/2018 |
| WO | 96/10937 | A1 | 4/1996 |
| WO | 98/48668 | A1 | 11/1998 |
| WO | 01/00061 | A1 | 1/2001 |
| WO | 2013/011052 | A1 | 1/2013 |
| WO | 2014/029696 | A1 | 2/2014 |

OTHER PUBLICATIONS

International Preliminary Report on Patentability received for PCT Patent Application No. PCT/EP2022/062164, mailed on Jan. 4, 2024, 8 pages.

International Search Report and Written Opinion received for PCT Patent Application No. PCT/EP2022/062164, mailed on Sep. 1, 2022, 10 pages.

Intention to Grant received for European Application No. 21181234.2, mailed on Mar. 4, 2024, 6 pages.

* cited by examiner

MOTION MECHANISM FOR A CHAIR AND CHAIR

CROSS REFERENCE TO RELATED APPLICATION

This application claims priority under 35 U.S.C. § 365 to PCT/EP2022/062164, filed on May 5, 2022, entitled "Motion Mechanism for a Chair and Chair," and European Patent Application No. EP21181234.2, filed Jun. 23, 2021, entitled "Motion Mechanism for a Chair and Chair," the entirety of the aforementioned applications are incorporated by reference herein.

TECHNICAL FIELD

The present invention relates to a motion mechanism for a chair. In particular, the present invention relates to a motion mechanism for a chair having a chair seat and a chair back, wherein the motion mechanism allows the chair seat and the chair back to be moved in a coordinated manner and to be inclined in various directions. The present invention relates furthermore to a chair comprising the motion mechanism.

BACKGROUND OF THE INVENTION

Common adjustments for chairs, in particular office-type chairs, include a height adjustment of the chair seat, an adjustment of an inclination of the chair seat and the chair back as well as an arrangement of the chair seat with respect to the chair back. These chair adjustments allow users to change their sitting position in the chair as desired, such that fatigue may be minimized during long sitting periods.

Chair configurations may implement a feature which allows a chair back and a chair seat to move simultaneously during a tilting or rearwards inclining motion of the chair back. The chair seat may also tilt in this motion or may be displaced otherwise relative to the chair base or chair back. The combined movement of the chair back and the chair seat may simplify chair adjustment. Further chair configurations may implement a feature which allows a chair back and/or a chair seat to be tilted in a sideward direction, either independent from each other or in a coordinated manner.

BRIEF SUMMARY OF THE INVENTION

There is a need in the art for a chair motion mechanism and a chair which address some of the above needs. In particular, there is a need in the art for a chair motion mechanism which is a simple and reliable construction and which provides easy adaption to different chair and motion requirements.

A motion mechanism for a chair is provided. The motion mechanism is configured to effect a coordinated movement of a chair seat and chair back of the chair. A seating surface of the chair seat extends essentially in a front-rear direction and a left-right direction of the chair. The chair back is arranged at a rear side of the chair seat. The chair back may extend essentially in the left-right direction and an up-down direction essentially perpendicular to the seating surface.

It is to be understood that the terms "front", "rear", "left", "right", "up" and "down", as used herein, each have a particular meaning that is defined in relation to a flat support surface beneath the chair, for example in relation to a floor on which the chair rests and in relation to an occupant sitting in a usual seated position on the chair. For example, the term "front" refers to a side of the chair seat at which the knees of the occupant are arranged and the legs are suspending, whereas the term "rear" refers to a side of the chair seat where the back of the occupant and the chair back are arranged. The term "left" refers to the left hand side of the chair seat as seen from the occupant sitting on the chair, and the term "right" refers to the right hand side of the chair seat as seen from the occupant sitting on the chair. The term "down" refers to the side facing to the flat support surface beneath the chair, and the term "up" refers to the side facing away from the flat support surface beneath the chair. It may be assumed that the resulting directions front-rear, left-right and up-down represent the axes of a three dimensional Cartesian coordinate system, usually named X-axis, Y-axis and Z-axis, respectively, which are orthogonal to each other. The front-rear and the left-right directions may extend in the plane of the flat support surface and the up-down direction may extend in a direction perpendicular to the flat support surface.

Tilting or inclining in the left-right direction, for example tilting the chair seat such that the left side of the chair seat moves up and/or the right side of the chair seat moves down or vice versa, or for example tilting the chair back such that an upper part of the chair back moves to the left or to the right whereas the lower part of the chair back essentially does not move, may be considered as a rotation around an axis of rotation which extends in the front-rear direction. A tilting or inclining in the front-rear direction, for example tilting the chair back such that an upper part of the chair back moves to the front or rear while the lower part of the chair back essentially does not move, may be considered as a rotation around an axis of rotation which extends in the left-right direction. Likewise, a tilting or inclining in the up-down direction, for example tilting the chair seat such that the front side of the chair moves up and/or the rear side of the chair moves down or vice versa, may be considered as a rotation around an axis of rotation which extends in the left-right direction.

Furthermore, it is to be understood that the chair seat, in particular when being tilted, does not extend exactly and only in the front-rear and left-right directions. However, it is clear to a person skilled in the art, that also in this tilted condition, the chair seat essentially extends in the front-rear and the left-right directions. Likewise, it is to be understood that the chair back does not extend exactly and only in the left-right and up-down directions, in particular when being tilted or inclined, but essentially extends in these directions.

The motion mechanism comprises a mechanism configured to support the chair seat and to couple the chair seat to a chair base assembly. The motion mechanism comprises furthermore a first back support and a second back support configured to couple the chair back to the mechanism. As the mechanism is that part the motion mechanism to which the chair seat, the chair base assembly and the chair back are coupled, it will be called in the following also base mechanism. As this base mechanism also may support tilting of the chair seat and the chair back in a coordinated or synchronized manner, it may also be considered as tilt mechanism or synchronization mechanism.

The first back support is configured to couple the chair back to the base mechanism. A first end of the first back support is coupled via a first rotary connection to the base mechanism. A second end of the first back support is configured for coupling to the chair back.

The second back support is configured to couple the chair back to the base mechanism. A first end of the second back support is coupled via a second rotary connection to the base mechanism, and a second end of the second back support is configured for coupling to the chair back.

An axis of rotation of the first rotary connection extends in the front-rear direction and an axis of rotation of the second rotary connection extends in the front-rear direction also.

The axes of rotation of the first and second rotary connections in the front-rear direction allow the first and second back supports to pivot the second ends selectively to the left or to the right, thus allowing the chair back to pivot to the left or to the right. For example, when an occupant sitting on the chair seat is leaning to the left or to the right, the chair back may move along with the back of the occupant to the left or to the right.

The second end of the first back support may comprise a first sliding connection for coupling to the chair back, and the second end of the second back support may comprise a second sliding connection for coupling to the chair back.

The first sliding connection may be configured to enable a shifting of a back surface of the chair back with respect to the second end of the first back support in the up-down direction. Likewise, the second sliding connection may be configured to enable a shifting of the back surface of the chair back with respect to the second end of the second back support in the up-down direction. The first sliding connection may be arranged spaced from the second sliding connection in the left-right direction.

When pivoting to the left or to the right, the second ends of the first and second back supports may need to vary their contact points at the chair back in the up-down direction to compensate their varying height upon rotation of the first and second back supports. Additionally, their contact points at the chair back may need to vary in the up-down direction when the chair back is inclined, for example tilted in the rearward direction. The first and second sliding connections allow such variation in the height of the contact points while providing reliable support in the left-right and front-rear directions.

Additionally or as an alternative, the second end of the first back support may comprise a first flexible connection for coupling to the chair back. The second end of the second back support may comprise a second flexible connection for coupling to the chair back.

The first flexible connection may comprise a first elastic element configured to enable an elastic displacement of the back surface of the chair back with respect to the second end of the first back support in the up-down direction, and the second flexible connection may comprise a second elastic element configured to enable an elastic displacement of the back surface of the chair back with respect to the second end of the second back support in the up-down direction. Each of the first and second elastic elements may comprise for example a corresponding rubber element or elastic part in the chair back, or a corresponding rubber element or elastic part between the back surface of the chair back and the first and second back supports, respectively. One end of each of the first and second elastic elements may be molded or glued to the chair back and another end of each of the first and second elastic elements may be molded or glued to the respective first and second back supports. The first flexible connection is arranged spaced from the second flexible connection in the left-right direction.

In a similar manner as the first and second sliding connections, the first and second elastic elements allow variation in the height of the contact points while providing reliable support in the left-right and front-rear directions.

The first rotary connection may be arranged spaced from the second rotary connection in the left-right direction. Thus, the first and second back supports may pivot in parallel. Inclining the back support in the left-right direction may be guided reliably and in a defined manner by the first and second back supports.

The first rotary connection may comprise a first pin extending in the front-rear direction. A first end of the first pin is mounted at the base mechanism and a second end of the first pin is rotatably inserted in a hole in the first end of the first back support. Likewise, the second rotary connection may comprise a second pin extending in the front-rear direction. A first end of the second pin is mounted at the base mechanism and a second end of the second pin is rotatably inserted in a hole in the first end of the second back support. The first and second pins may be made of metal, for example steel, and may have a cylindrical shape. The pin and the hole may constitute a plane bearing with the pin acting as a shaft and the hole acting as a bushing. In another example, in each hole a corresponding bushing may be provided. The bushings may be made of metal or any other adequate material for constituting a plane bearing in connection with the pins. A mounting by means of a plane bearing may be adequate for the required rotation and expected forces from the back supports and may be cost-effective in view of material and manufacturing.

The first back support may have an L-shape extending from the first end of the first back support to the second end of the first back support. The second back support may have an L-shape extending from the first end of the second back support to the second end of the second back support. The first back support and the second back support may have a similar shape, for example the first back support and the second back support may have mirror symmetrical shapes with respect to each other. The L-shapes allow a compacted design of the base mechanism beneath the chair seat.

The motion mechanism may comprise a spherical joint coupling the chair seat and the base mechanism at a central position as viewed in the left-right direction of the base mechanism and the chair seat. The spherical joint may be arranged, as viewed in the front-rear direction, between a center and the rear side of the chair seat. The spherical joint may allow the chair seat to tilt around a left-right axis as well tilting around a front-rear axis. The arrangement of the spherical joint in the central position in the left-right direction and between the center and the rear side of the chair seat in the front-rear direction supports an occupant essentially at the center of gravity. Tilting the chair seat to the front, rear, left or right may be accomplished by small movements and low force application by the occupant while sitting on the chair.

The motion mechanism may furthermore comprise a third sliding connection coupling the chair seat to the chair back at the left side and a fourth sliding connection coupling the chair seat to the chair back at the right side. In particular, the third sliding connection may be arranged at the left side of the chair seat and chair back, and the fourth sliding connection may be arranged at the right side of the chair seat and chair back.

The third sliding connection may be configured to enable a coordinated movement in the front-rear direction and the up-down direction. The fourth sliding connection may also be configured to enable a coordinated sliding movement in the front-rear direction and the up-down direction. The third and fourth sliding connections enable an independent tilting of the chair seat and the chair back, at least within a moving range of the third and fourth sliding connections. For example, the third sliding connection comprises a guiding slot extending in the front-rear and up-down directions and a third pin slidingly supported in the guiding slot. The fourth sliding connection may comprise a guiding slot extending in the front-rear and up-down directions and a fourth pin slidingly supported in the guiding slot. The guiding slots may be provided at lower side of the chair back and the third and fourth pins may be provided at a rear side of the chair seat. A reverse arrangement is also possible, i.e. the guiding slots may be provided at the rear side of the chair seat and the third and fourth pins may be provided at the lower side of the chair back.

Furthermore, the motion mechanism may comprise a locking mechanism mounted at the base mechanism and configured to engage with at least one of the first and second back supports for inhibiting a rotation of the at least one of the first and second back supports upon actuating the locking mechanism. The locking mechanism may comprise a lever which is easily accessible by an occupant sitting on the chair for either locking or unlocking the locking mechanism. In the locked state, at least the tilting of the chair back in the left-right direction is inhibited.

For example, the locking mechanism may comprise a lock plate which is movable in the front-rear direction. The lock plate may comprise a protruding lock form configured to be selectively engaged into or disengaged from a corresponding recess form provided at the at least one of the first and second back supports. For example, for locking the locking mechanism, the lock plate may be moved in the rearward direction such that it is engaged into the recesses in the back supports. For unlocking the locking mechanism, the lock plate may be moved in the forward direction such that it is disengaged from the recesses in the back supports.

Inhibiting or allowing a tilting of the chair back in the front-rear direction may also be controlled by the locking mechanism or may be controlled by a further locking mechanism.

A chair comprises a chair base assembly, a chair seat, a chair back, and the motion mechanism described above. The base mechanism of the motion mechanism is attached to the chair base assembly and the chair seat. The chair back is attached to the first and second back supports of the motion mechanism.

The motion mechanism and the chair may be utilized for various applications in which an inclining motion of the chair back and an inclining motion of the chair seat are desired, in particular inclining motions in the left-right direction also. For example, the motion mechanism may be utilized in an office chair.

BRIEF DESCRIPTION OF THE SEVERAL VIEWS OF THE DRAWING

Embodiments of the invention will be described with reference to the accompanying drawings.

DETAILED DESCRIPTION OF THE INVENTION

Exemplary embodiments of the invention will be described with reference to the drawings. While some embodiments will be described in the context of specific fields of application, such as in the context of an office type chair, the embodiments are not limited to this field of application. The features of the various embodiments may be combined with each other unless specifically noted otherwise. Same reference signs in the various drawings refer to similar or identical components.

Figure 1:
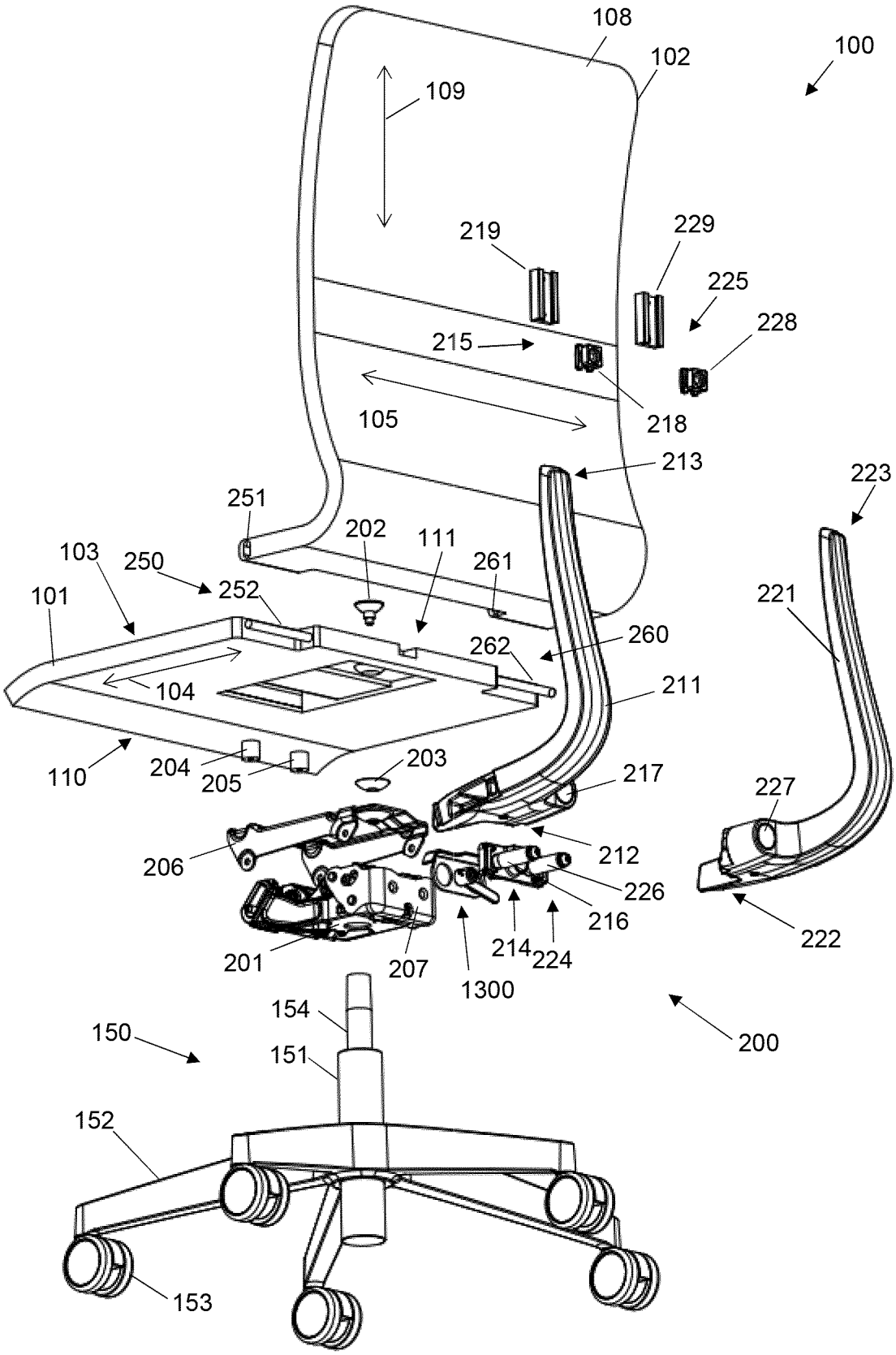
FIG. 1 is a schematic isometric exploded view of a chair having a chair motion mechanism according to an embodiment.

FIG. 1 shows a chair 100 which includes a motion mechanism 200. The chair 100 is illustrated to be an office-type chair having a chair base assembly 150 and a superstructure. The superstructure includes a chair seat 101, a chair back 102 and the motion mechanism 200 which connects the chair seat 101, the chair back 102 and the chair base assembly 150. The motion mechanism 200 may effect a coordinated motion of the chair back 102 and the chair seat 101. The chair base assembly 150 includes a pedestal column 151, a number of support legs 152 extending radially from the column 151 and a corresponding number of casters 153 supported on the outer ends of the support legs 152. Additionally, a gas cylinder 154 or other lifting mechanism may be supported by the column 151 to enable the height of the chair seat 101, and thus of the chair superstructure, to be adjusted by an occupant.

The terms "front", "rear", "left", "right", "up" and "down", as used herein, have been defined above. It is to be understood that the terms "forward", "rearward" and "lateral" as used herein, also each have a particular meaning that is defined in relation to a flat support surface beneath the chair 100 and in relation to an occupant of the chair. For example, the term "forward" refers to a direction moving away from the chair back 102 and in front of a chair occupant along an axis which extends parallel to such a flat support surface, while the term "rearward" refers to a direction opposite to the forward direction. The term "lateral" refers to a generally horizontal direction perpendicular to both the forward and rearward direction and extending parallel to the aforementioned flat support surface. For example, terms like "to the left" and "to the right" are lateral directions as seen from an occupant sitting on the chair.

The motion mechanism 200 comprises a base mechanism 201 which is arranged at the top side of the gas cylinder 154 and which is configured to support the chair seat 101. Furthermore, the motion mechanism 200 comprises a first back support 211 and a second back support 221. Each of the first and second back supports 211, 221 are L-shaped and extend from the base mechanism 201 to a rear side 108 of the chair back 102. The first and second back supports 211, 221 are mounted at a back support plate 207 of the base mechanism 201. The chair seat 101 is mounted at a seat support plate 206 of the base mechanism 201. The back support plate 207 and the seat support plate 206 are movably connected at the mechanism 201 such that the first and second back supports 211, 221 and the chair seat 101 may be tilted in a coordinated manner under the control of the base mechanism 201. For example, the chair seat 101 and the chair back 102 may be movable between a zero tilt position shown in FIG. 5 and a back tilted position shown in FIG. 6. In the zero tilt position, a seating surface 103 of the chair seat 101 may extend essentially in a front-rear direction 104 as indicated by a double arrow in FIG. 1 and in a left-right direction 105 as indicated by a double arrow in FIG. 1. In the zero tilt position, the back surface 108 of the chair back 102 may extend essentially in an up-down direction 109 as indicated by a double arrow in FIG. 1 and in the left-right direction 105. When moving from the zero tilt position to the back tilted position, an upper part of the chair back 102 may travel a longer distance in the rearward direction than a lower part of the chair back 102 thus inclining the chair back 102. The chair seat 101 may move in a coordinated manner together with the chair back 102, for example a rear side 111 of the chair seat 101 may be lowered and a front side 110 of the chair seat 101 may be raised when the chair back 102 is moving from the zero tilt position to the back tilted position. A movement from the zero tilt position to the back tilted position and reverse may be controlled by an occupant sitting on the chair 100. The occupant may control the chair 100 to take any position between the zero tilt position and the back tilted position shown in FIGS. 5 and 6, respectively.

The chair seat 101 is mounted at the seat support plate 206 via a spherical joint 202 and two elastic buffer elements 204 and 205, for example rubber pads. The spherical joint 202 may be arranged, viewed in the left-right direction, in the center of the chair seat 101. Viewed in the front-rear direction, the spherical joint 202 may be arranged between a center and the rear side 111 of the chair seat 101. The spherical joint 202 may comprise a bearing seat 203 arranged between the seat support plate 206 and a lower surface of the chair seat 101. The spherical joint 202 may allow the chair seat 101 to be tilted around an axis of rotation in the left-right direction 105 and an axis of rotation in the front-rear direction 104 with respect to the seat support plate 206. The elastic buffer elements 204 and 205 may be arranged near the front side 110 of the chair seat 101. For example, in the left-right direction 105, the buffer element 204 may be arranged between a center of the chair seat 101 and a left side of the chair seat 101, and the buffer element 205 may be arranged between the center of the chair seat 101 and a right side of the chair seat 101. As a result, the chair seat 101 is mounted at three positions at the seat support plate 206. The three positions constitute a triangle.

A first end 212, i.e. the lower end, of the first back support 211 is rotatably mounted at the back support plate 207 via a first rotary connection 214. A first end 222, i.e. the lower end, of the second back support 221 is rotatably mounted at the back support plate 207 via a second rotary connection 224. The axes of rotation of the first rotary connection 214 and the second rotary connection 224 are parallel to each other, extend in the front-rear direction 104, and are arranged spaced in the left-right direction 105. As shown in FIG. 1, the first rotary connection 214 may comprise a first pin 216 mounted at the back support plate 207 and a first hole 217 provided in the first end 212 of the first back support 211. The first pin 216 and the first hole 217 may cooperate as a plain bearing. The second rotary connection 224 may comprise a second pin 226 mounted at the back support plate 207 and a second hole 227 provided in the first end 222 of the second back support 221. The second pin 226 and the second hole 227 may cooperate as a plain bearing. The first and second rotary connections 214, 224 may be implemented in any other suitable way, for example by means of roller bearings, or by pins at the first ends and holes or bushings provided at the back support plate.

Figure 13:
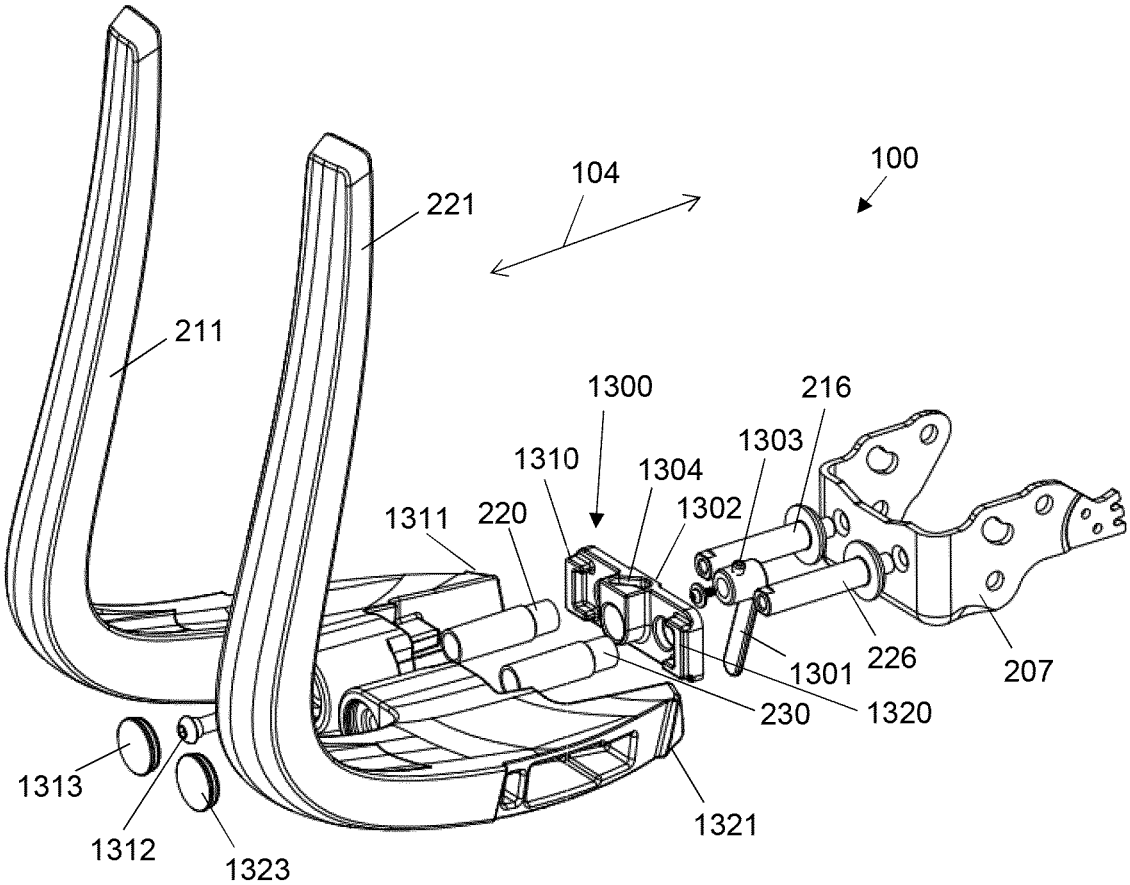
FIG. 13 is a schematic isometric exploded view illustrating details of a locking mechanism of the chair motion mechanism of FIG. 1.

For example, as shown in more detail in FIG. 13, in each hole 217, 227 a corresponding bushing 220, 230 may be provided. The bushings 220, 230 may be made of metal or any other adequate material for constituting a plane bearing in connection with the pins 216, 226. For securing the first back support 211 at the first rotary connection 214, a first bolt 1312, for example a screw, may be provided at the free end of the first pin 216. The first bolt 1312 may be covered by a first cap 1313. For securing the second back support 221 at the second rotary connection 224, a second bolt (not shown in FIG. 13), for example a screw, may be provided at the free end of the second pin 226. The second bolt may be covered by a second cap 1323.

The motion mechanism 200 comprises furthermore a locking mechanism 1300. The locking mechanism 1300 comprises a lever 1301 which may be operated by an occupant to set the locking mechanism 1300 in either a locked state or an unlocked state. In the locked state, the locking mechanism 1300 engages with at least one of the first and second back supports 211, 221 to inhibit a rotation of the corresponding back support(s). In the unlocked state, the locking mechanism 1300 is disengaged from the first and second back supports 211, 221. Further details concerning the locking mechanism 1300 will be described in connection with FIGS. 13 to 16.

As further shown in FIG. 1, a second end 213, i.e. the upper end, of the first back support 211 is coupled to the back surface 108 of the chair back 102. The second end 213 may be coupled to the back surface 108 via a first sliding connection 215. The first sliding connection may enable sliding of the back surface 108 of the chair back 102 with respect to the second end 213 of the first back support 211 in the up-down direction 109. The first sliding connection 215 may comprise for example a sliding piece 218 mounted at the second end 213 of the first back support 211 and a track 219 mounted at the back surface 108 of the chair back 102. The sliding piece 218 may be engaged with the track 219 such that the sliding piece 218 is retained by the rail 219 and is slidable in the up-down direction 109 with respect to the rail 219. A second end 223, i.e. the upper end, of the second back support 221 is coupled to the back surface 108 of the chair back 102. The second end 223 may be coupled to the back surface 108 via a second sliding connection 225. The second sliding connection 225 may enable sliding of the back surface 108 of the chair back 102 with respect to the second end 223 of the second back support 221 in the up-down direction 109. The second sliding connection 225 may comprise for example a sliding piece 228 mounted at the second end 223 of the second back support 221 and a track 229 mounted at the back surface 108 of the chair back 102. The sliding piece 228 may be engaged with the track 229 such that the sliding piece 228 is retained by the rail 219 and is slidable in the up-down direction 109 with respect to the rail 229.

The second ends 213, 223 may be coupled to the back surface 108 of the chair back 102 in any other appropriate manner, for example by means of flexible connections, for example elastic elements configured to enable an elastic movement of the back surface 108 with respect to the second ends 213, 223 in the up-down direction 109. The elastic elements may be made of rubber or silicone and may be integrated, at least partially, in the back surface 108.

In any way, the coupling between the second ends 213, 223 and the back surface 108 may be configured such that a traveling distance in the up-down direction 109 of the few millimeters, for example at least 5, 10 or 20 mm is achieved. The coupling of the second end 213 to the back surface 108 is arranged spaced from the coupling of the second end 223 to the back surface 108 in the left-right direction 105. A movement of the second end 213 with respect to the back surface 108 may be independent from a movement of the second end 223 with respect to the back surface 108.

Figure 2:
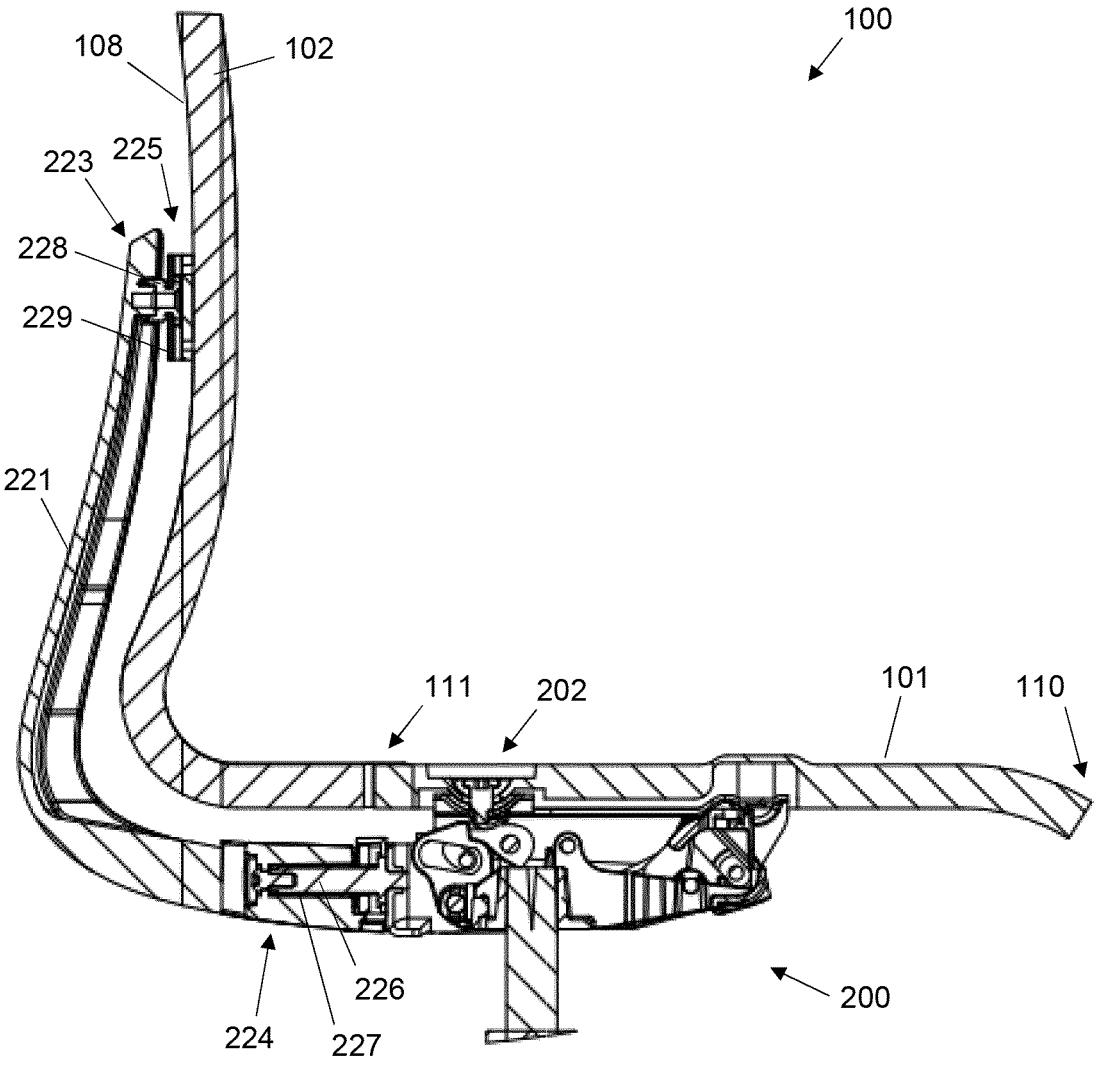
FIG. 2 is a schematic cross-sectional side view of the chair of FIG. 1 in a zero tilt position.

FIG. 2 shows a sectional side view of the superstructure of the chair 100 in an assembled state. In particular, FIG. 2 shows a sectional view through the spherical joint 202 and a sectional view through the second rotary connection 224 and the second sliding connection 225. Although these components are not located within the same sectional plane, they are shown commonly in FIG. 2 for reasons of clarity and brevity.

As furthermore shown in FIGS. 1 and 2, a lower side of the chair back 102 is coupled to the rear side 111 of the chair seat 101, for example via sliding connections. For example, a sliding connection 250 (named third sliding connection in the claims) may be arranged at the left side of the chair 100 between the lower side of the chair back 102 and the rear side 111 of the chair seat 101, and a further sliding connection 260 (named fourth sliding connection in the claims) may be arranged at the right side of the chair 100 between the lower side of the chair back 102 and the rear side 111 of the chair seat 101. Each of the sliding connections 250, 260 may be composed of a corresponding long hole or slot 251, 261 provided in the lower side of the chair back 102, and a corresponding pin 252, 262 provided at the rear side 111 of the chair seat 101. The pin 252 is arranged within the slot 251. The pin 262 is arranged within the slot 261. The slot 251 defines a traveling path for the pin 252 in the up-down and front-rear directions 104, 109. Likewise, the slot 261 defines a similar traveling path for the pin 262 in the up-down and front-rear directions 104, 109. As a result, the lower side of the chair back 102 is movable with respect to the rear side 111 of the chair seat 101 along the traveling paths. Furthermore, rotation of the lower side of the chair back 102 with respect to the rear side 111 of the chair seat 101 is achieved by a cylindrical shape of the pins 252, 262. It is to be noted that traveling of the pin 252 in the slot 251 at the left side of the chair is independent from traveling of the pin 262 in the slot 261 at the right side of the chair.

Figure 3:
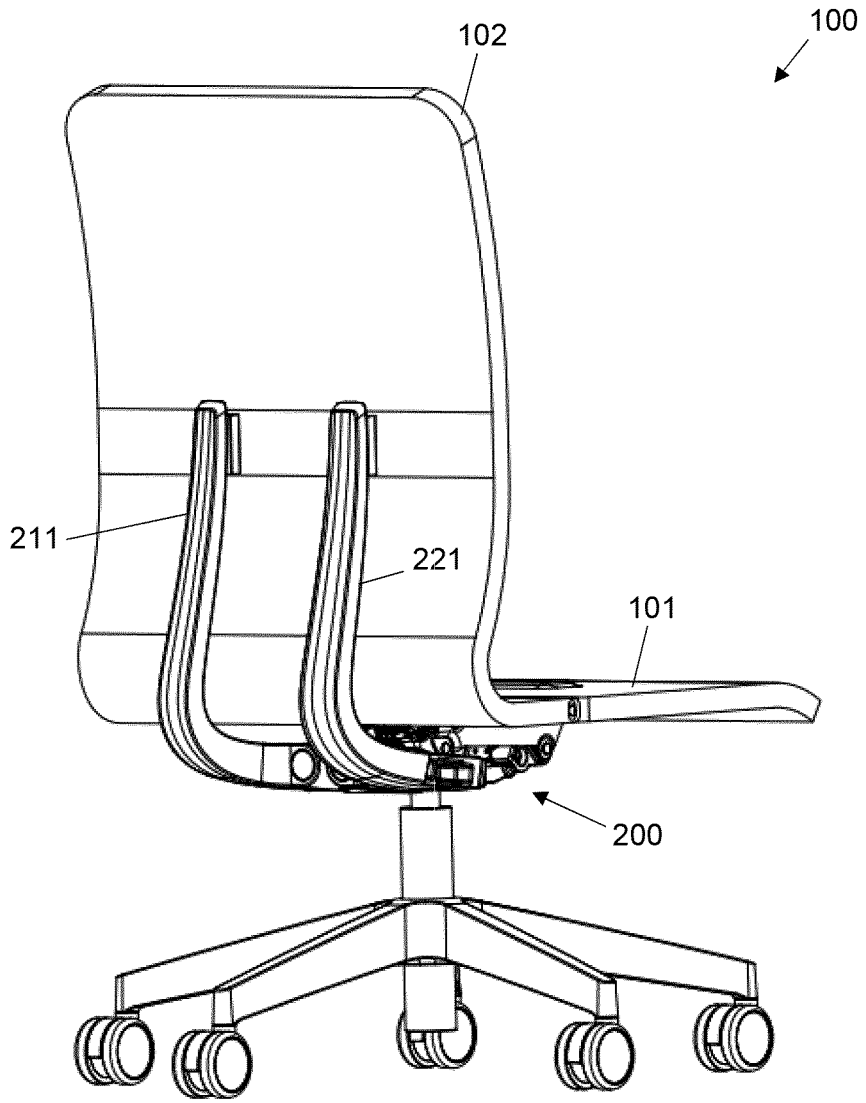
FIG. 3 is a schematic isometric view of the chair of FIG. 1 viewed from a rear right side.

FIG. 3 shows a perspective view of the chair 100 of FIG. 1 in an assembled state in a rear right view. The chair 100 is in a zero tilt position, i.e. the chair back 102 is essentially in an upright position and the chair seat 101 is essentially in a plane position.

Figure 4:
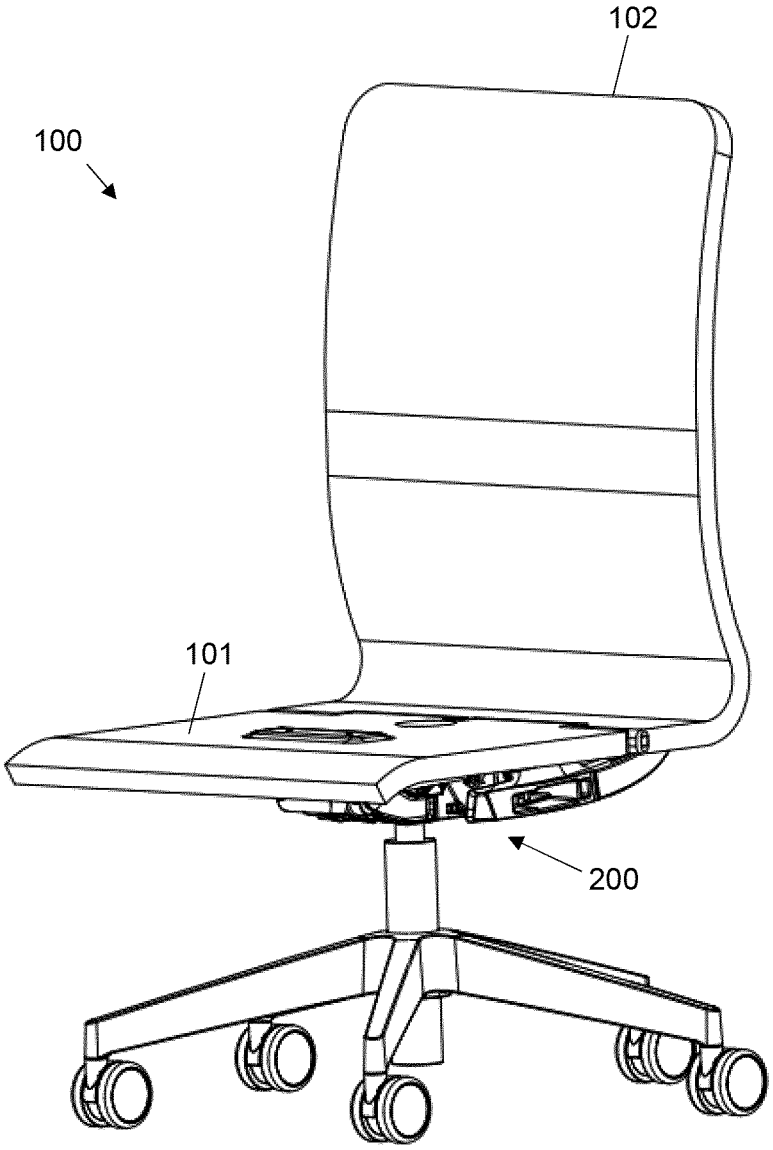
FIG. 4 is a schematic isometric view of the chair of FIG. 1 viewed from a front left side.

FIG. 4 shows a perspective view of the chair 100 of FIG. 3 in a front left view. Handlebars, for example for adjusting the height of the chair 100 or controlling tilting of the chair back 102 and/or the chair seat 101 are not shown in the figures for reasons of clarity.

The functioning of the motion mechanism 200 will be explained in the following with respect to FIGS. 5 to 12.

Figure 5:
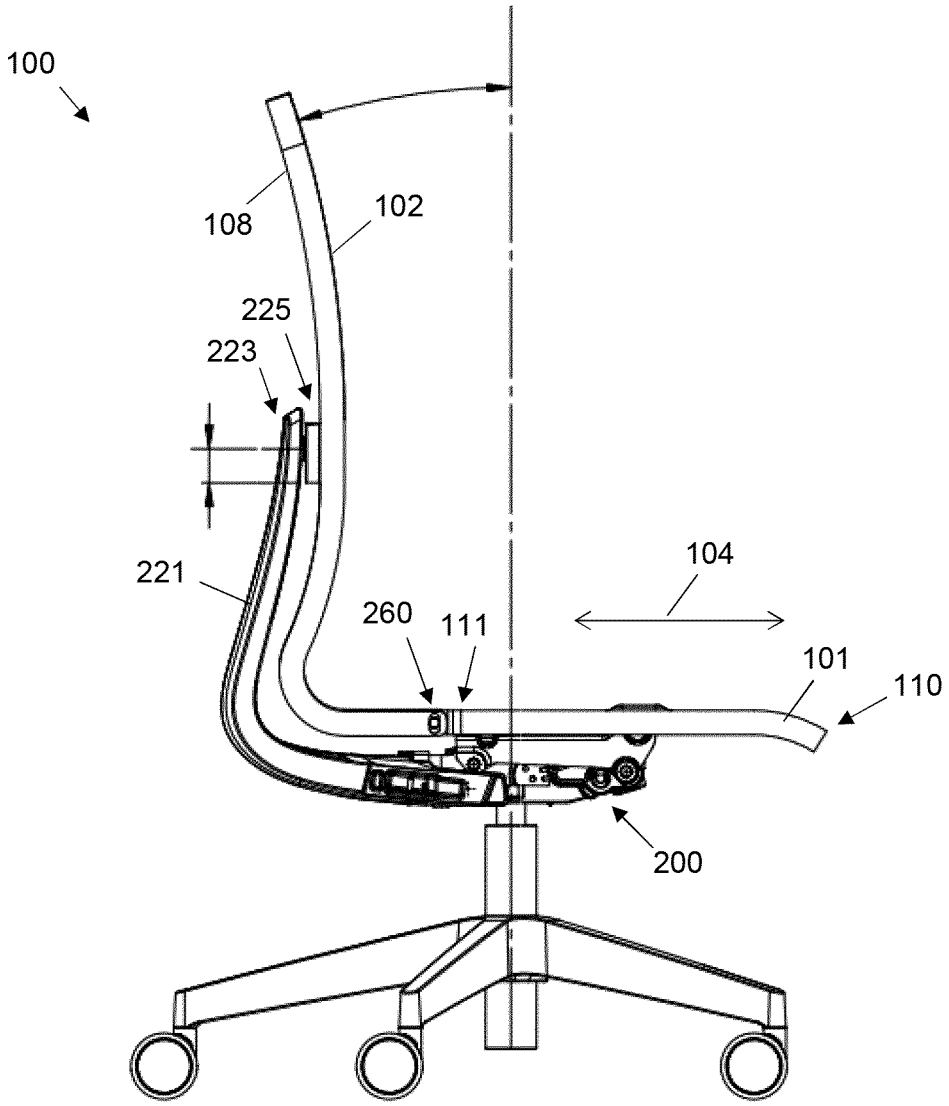
FIG. 5 is a schematic side view of the chair of FIG. 1 in a zero tilt position.
Figure 6:
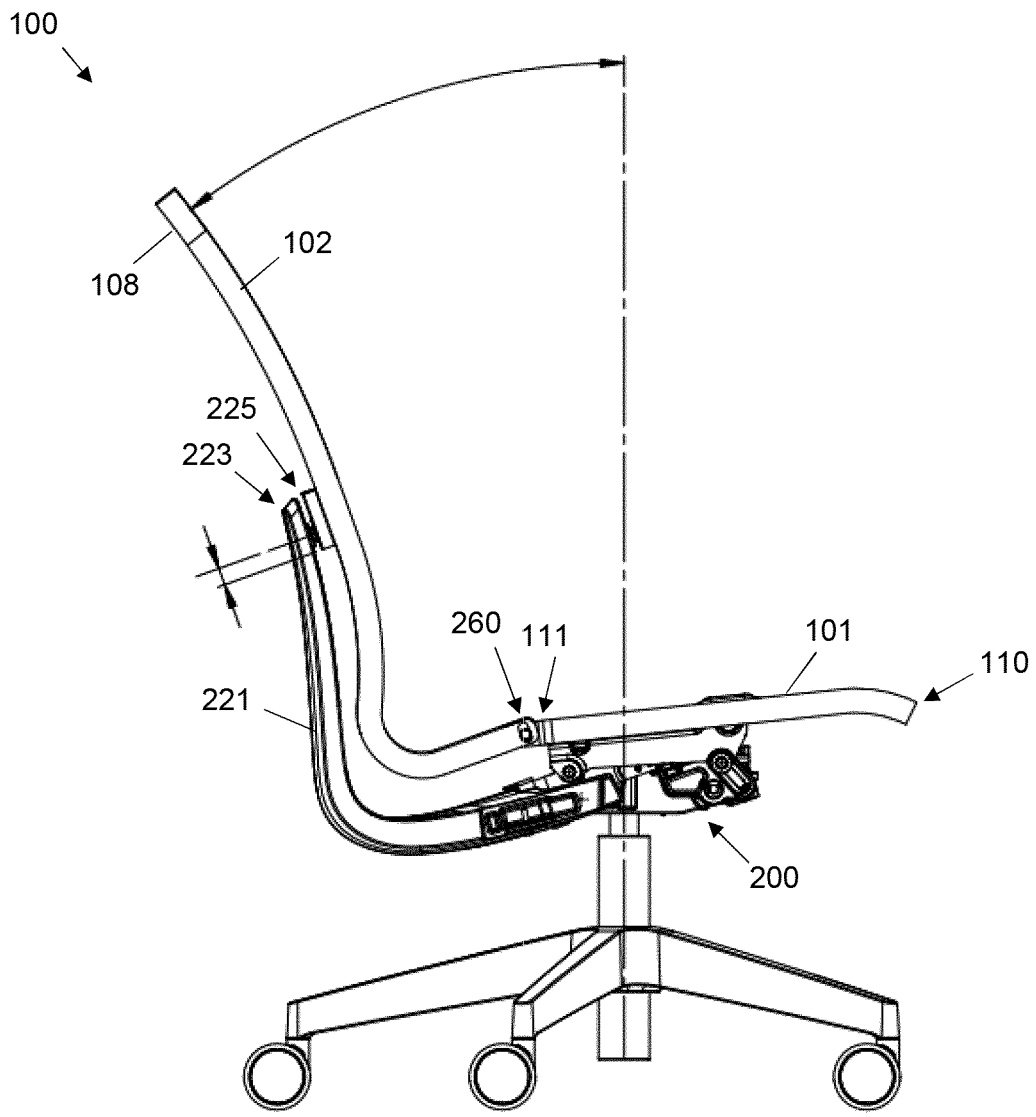
FIG. 6 is a schematic side view of the chair of FIG. 1 in a back tilted position.

FIG. 5 shows the chair 100 in the zero tilt position. The chair back 102 is essentially in an upright position and the chair seat 101 is essentially in a plane position. When an occupant is sitting on the chair 100, the occupant may lean back against the chair back 102. Upon the force being exerted on the chair back 102 by the occupant in the rear direction, the chair back 102 may be tilted as shown in FIG. 6. The tilting motion is communicated by the first and second back supports 211, 221 via the back support plate 207 to the base mechanism 201. Within the base mechanism 201, the back support plate 207 is mechanically coupled to the seat support plate 206 such that a coordinated movement of the back support plate 207 and the seat support plate 206 is achieved. As a result, the chair seat 101 is moved by the seat support plate 206 in the rearward direction and at the same time tilted such that the rear side 111 of the chair seat 101 is lowered and the front side 110 of the chair seat 101 is raised as shown in FIG. 6. The base mechanism 201 may provide a restoring force, for example by means of a spring arrangement within the base mechanism 201, which urges the chair back 102 and the chair seat 101 back into the zero tilt position when the force exerted by the occupant on the chair back 102 is released. As can be seen in FIGS. 5 and 6, when moving from the zero tilt position to the tilted position, the second ends 213, 223 of the first and second back supports 211, 221 may move in the up-down direction with respect to the back surface 108 of the chair back 102. The first and second sliding connections 215, 225 enable such movement. Furthermore, the lower side of the chair back 102 moves and rotates with respect to the rear side 111 of the chair seat 101 as enabled by the sliding connections 250, 260.

Figure 7:
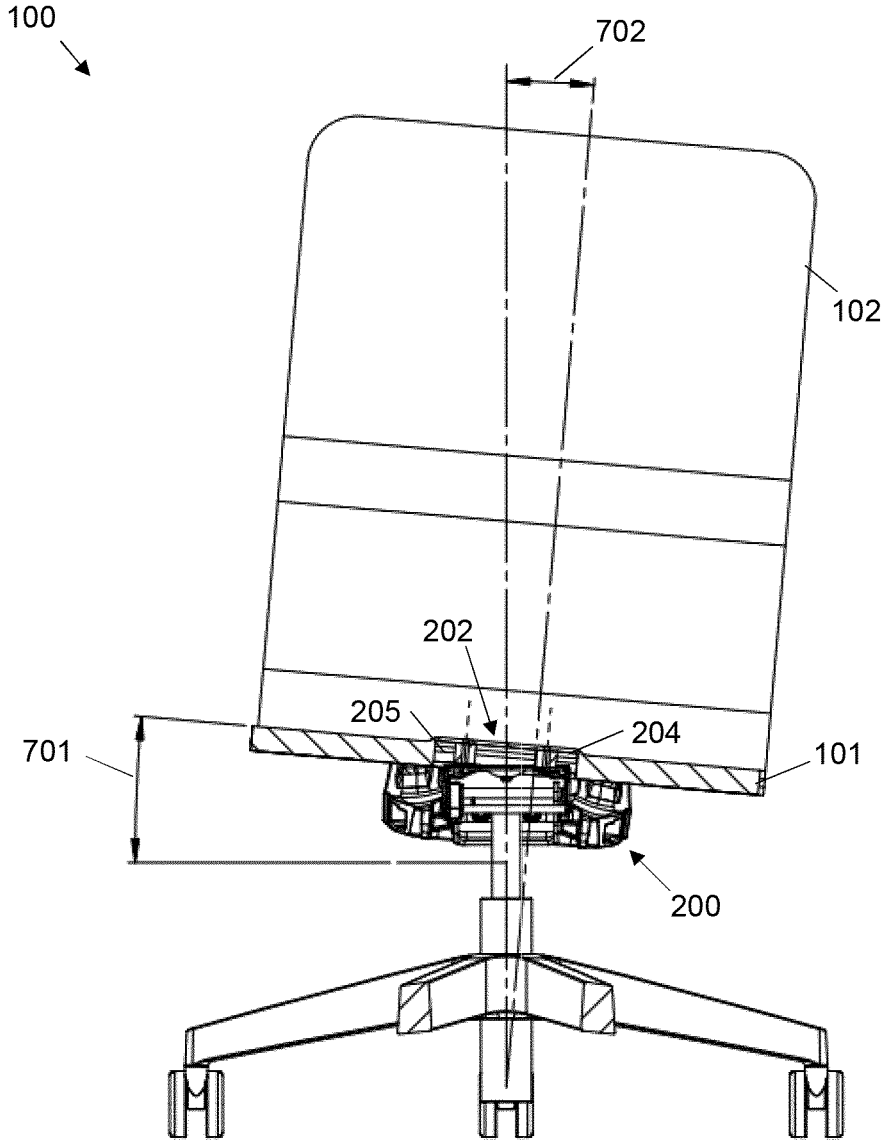
FIG. 7 is a schematic front view of the chair of FIG. 1 in a position tilted to the left.

Alternatively or additionally, an occupant sitting on the chair 100 may lean to the left or to the right. For example, when leaning to the left, the occupant may exert force on the left side of the chair seat 101 in the downward direction. As discussed above, the chair seat 101 is coupled to the base mechanism 201 via the spherical joint 202 and the buffer elements 204, 205. Upon a force in the downward direction on the left side of the chair seat 101, the chair seat 101 may tilt to the left as shown in FIG. 7. It is to be noticed that FIG. 7 is a front view such that the left side as seen from an occupant sitting on the chair 100 is at the right side in FIG. 7.

The chair seat 101 may rotate around an axis of rotation in the front-rear direction 104 with the axis of rotation passing through the spherical joint 202. Buffer element 204 may be compressed whereas buffer element 205 may be unloaded or stretched. An angle of rotation 701, i.e. the angle of the tilting to the left, may depend on the amount of force being exerted on the left side of the chair seat 101, and may be restricted by the spherical joint 202 and/or the buffer elements 204, 205. The buffer elements 204, 205 may provide a restoring force urging the chair seat 101 back in the zero tilt position when being unloaded.

Figure 8:
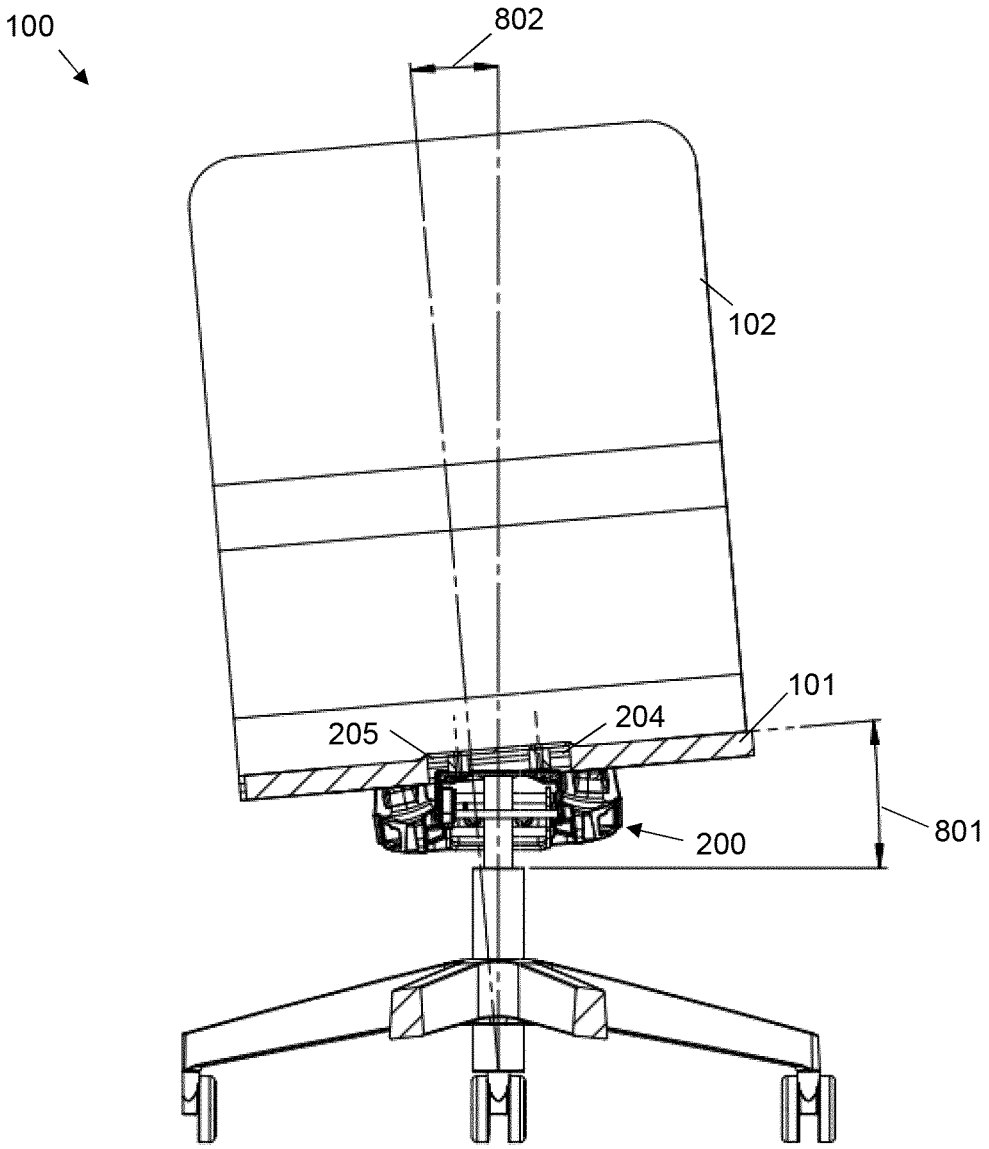
FIG. 8 is a schematic front view of the chair of FIG. 1 in a position tilted to the right.

When an occupant sitting on the chair 100 leans to the right, a force is exerted on the right side of the chair seat 101 in the downward direction. Upon the force in the downward direction on the right side of the chair seat 101, the chair seat 101 may tilt to the right as shown in FIG. 8. It is to be noticed that FIG. 8 is a front view such that the right side as seen from an occupant sitting on the chair 100 is at the left side in FIG. 8. The chair seat 101 may rotate around the axis of rotation provided by the spherical joint 202 in the front-rear direction 104. Buffer element 205 may be compressed whereas buffer element 204 may be unloaded or stretched. An angle of rotation 801, i.e. the angle of the tilting to the right, may depend on the amount of force being exerted on the right side of the chair seat 101 and may be restricted by the spherical joint 202 and/or the buffer elements 204, 205.

Figure 9:
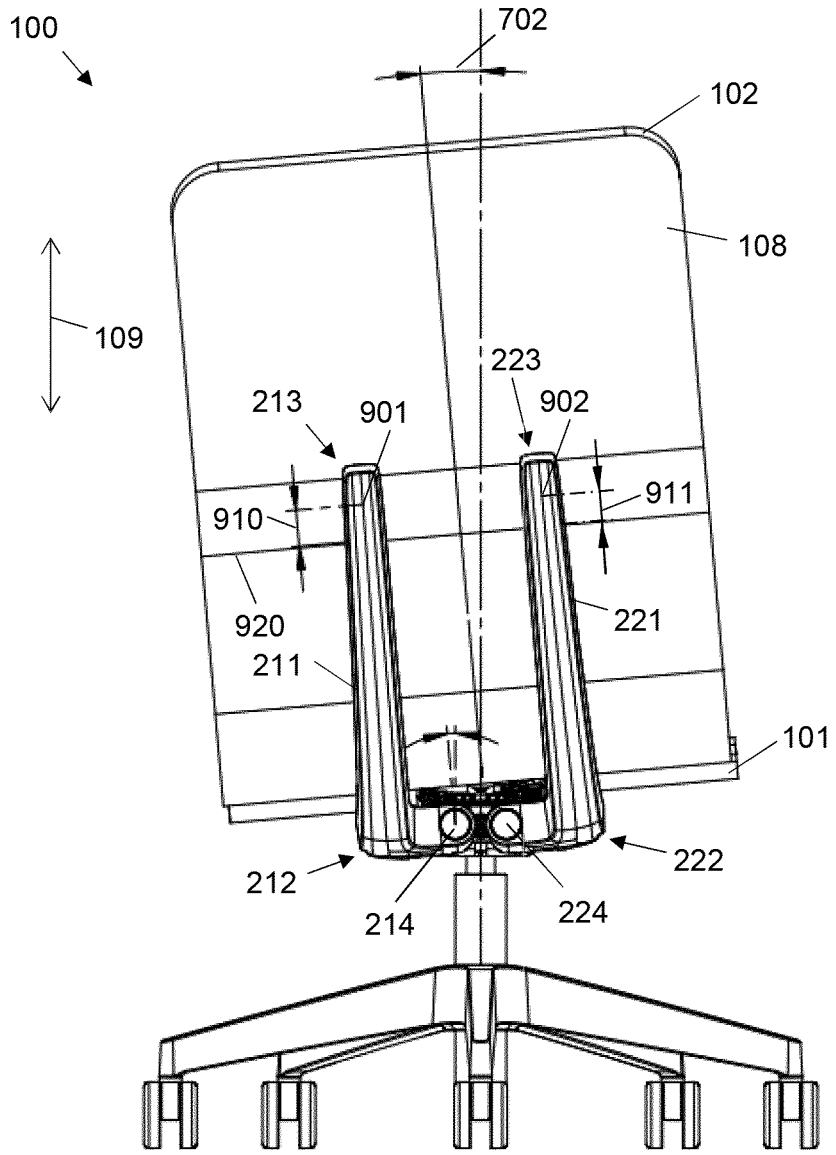
FIG. 9 is a schematic rear view of the chair of FIG. 1 in a position tilted to the left.
Figure 10:
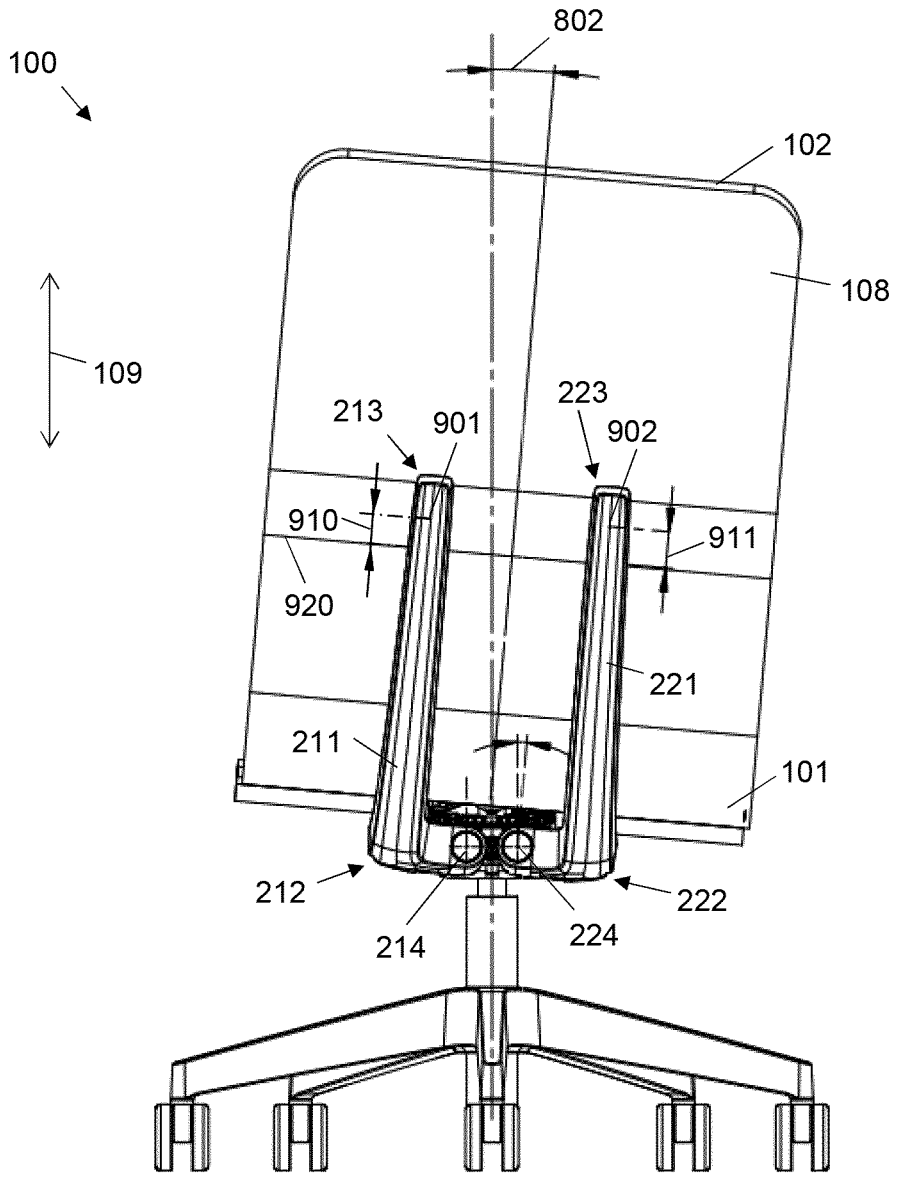
FIG. 10 is a schematic rear view of the chair of FIG. 1 in a position tilted to the right.

Simultaneously, the chair back 102 may be tilted to the left or right, for example upon a force exerted by the occupant's back on the chair back 102 or exerted via the sliding connections 250, 260 from the chair seat 101 on the lower side of the chair back 102. FIG. 9 shows the chair back 102 in a position tilted to the left by a tilt angle 702. FIG. 10 shows the chair back 102 in a position tilted to the right by a tilt angle 802. It is to be noticed that FIGS. 9 and 10 are front views such that, in contrast to FIGS. 7 and 8, the left side as seen from an occupant sitting on the chair 100 is at the left side in FIGS. 9 and 10, and the right side as seen from an occupant sitting on the chair 100 is at the right side in FIGS. 9 and 10. Tilting the chair back 102 to the left or to the right is enabled by the first and second rotary connections 214, 224 which enable rotation of the first ends 212, 222 of the first and second back supports 211, 221 with respect to the back support plate 207 as illustrated in FIGS. 9 and 10. As can be seen from FIGS. 9 and 10, contact points 901, 902 between the second ends 213, 223 and the back surface 108 of the chair back 102 may vary in the up-down and direction 109 when tilting the chair back 102 from a zero tilt position to the tilted positions, i.e. tilted to the left as shown in FIG. 9 or tilted to the right as shown in FIG. 10. For example, a distance 910 between contact point 901 and a reference line 920 at the back surface 108 of the chair back 102 becomes smaller when tilting the chair back 102 from the left to the right. A distance 911 between contact point 902 and the reference line 920 becomes larger when tilting the chair back 102 from the left to the right. This may be compensated by the sliding connections 215, 225 as discussed above or by corresponding flexible connections provided at the contact points 901, 902 between the second ends 213, 223 and the back surface 108 of the chair back 102.

As explained above, the tilting of the chair back 102 may be effected by a force communicated via the sliding connections 250, 260 from the chair seat 101. However, it to be noticed that the tilt angle 702, 802 of the chair back 102 and the tilt angle 701, 801 of the chair seat 101 may be different and independent from each other. Due to the sliding connections 250, 260, there is a degree of freedom for the chair back 102 to vary its tilt angle with respect to the chair seat 101. For example, the tilt angle 702, 802 of the chair back 102 may be varied within the range of a few degree, for example −5° to +5°, with respect to the tilt angle 701, 801 of the chair seat 101. In detail, the pin 262 of sliding connection 260 may vary its position within the slot 261 independent from a position of the pin 252 of sliding connection 250 within the slot 251.

Figure 11:
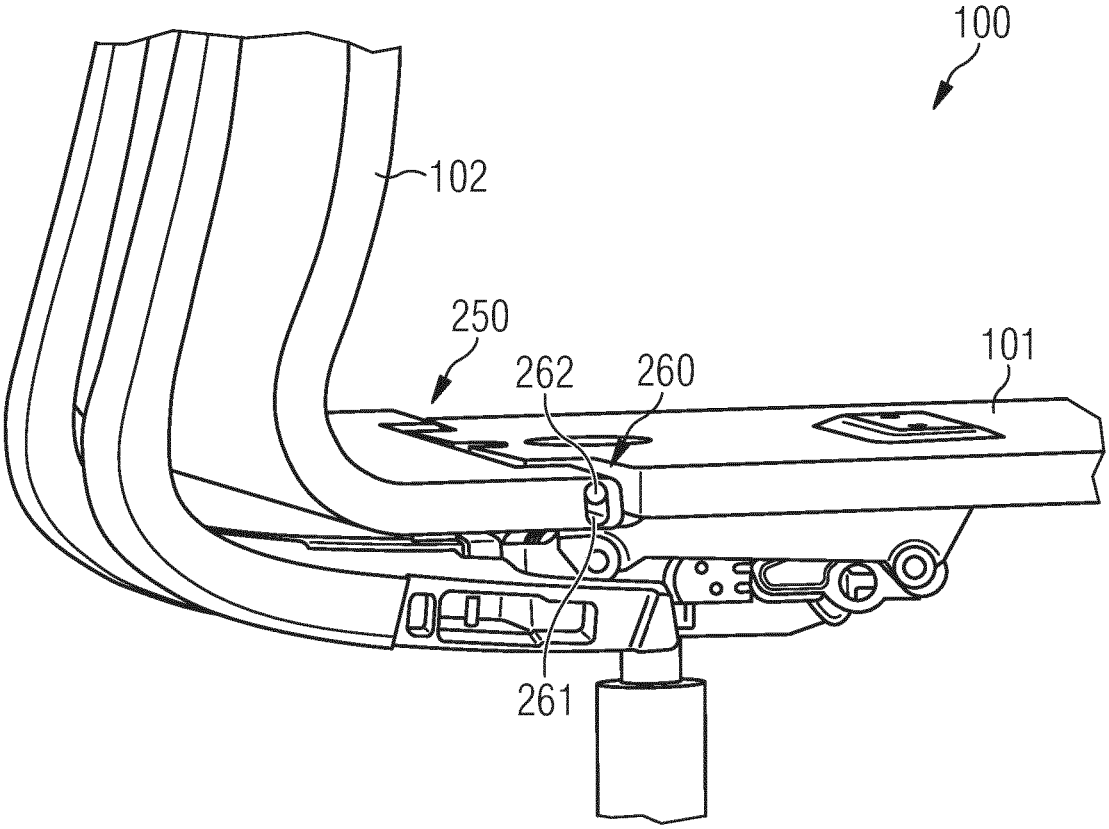
FIG. 11 is a schematic partial isometric view of the chair of FIG. 1 in a position tilted to the right.

For example, as shown in FIG. 11, sliding connections 250, 260 may effect that the chair back 102 is tilted to the right with respect to the chair seat 101. In another example, as shown in FIG. 12, the sliding connections 250, 260 may effect that the chair back 102 is tilted to the left with respect to the chair seat 101.

Figure 12:
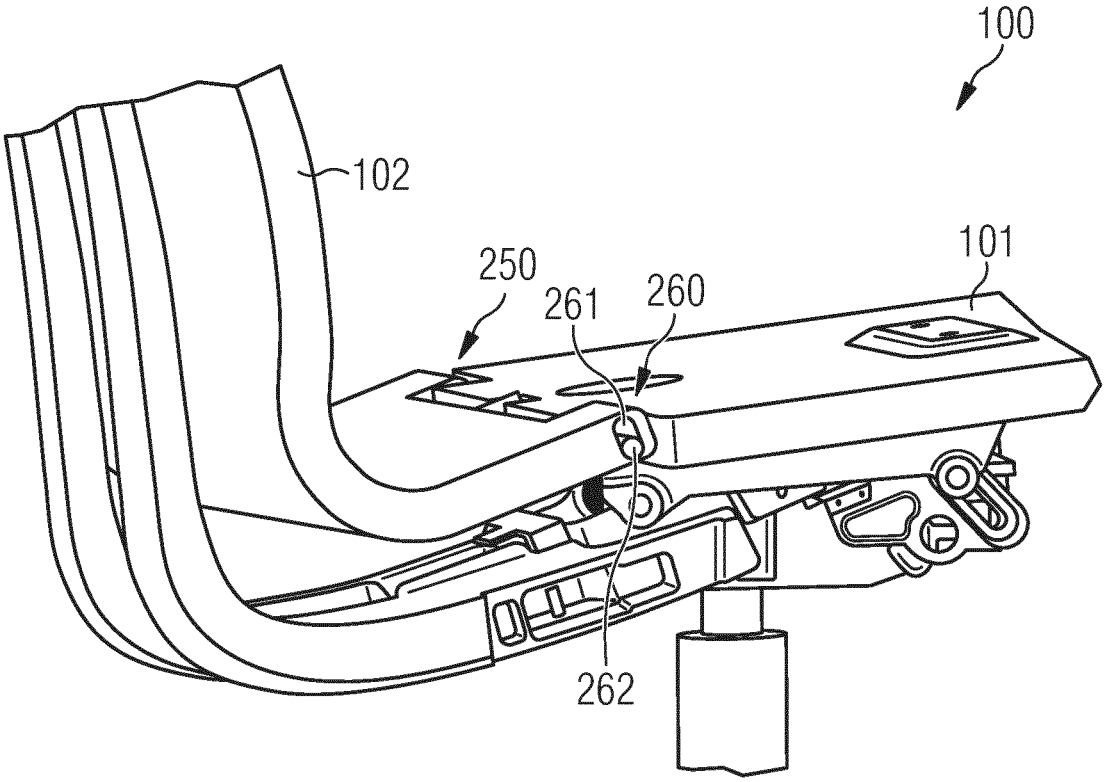
FIG. 12 is a schematic partial isometric view of the chair of FIG. 1 in a position tilted back and to the left.

Additionally, as shown in FIGS. 11 and 12, the sliding connections 250, 260 allow an independent tilting of the chair seat 101 and the chair back 102 around an axis of rotation in the left-right direction 105, i.e. a tilt angle of the chair back 102 in the front-rear direction is independent from a tilt angle of the chair seat 101 in the up-down direction.

FIG. 13 illustrates details of the locking mechanism 1300. The locking mechanism 1300 is provided at the back support plate 207 of the base mechanism 201. The locking mechanism 1300 comprises a lever 1301 and a lock plate 1302. The lever 1301 can be rotated around an axis of rotation extending in the front-rear direction 104. Upon rotation of the lever 1301, the lock plate 1302 may be moved in the front-rear direction 104. For example, a peg 1303 may be provided at the lever 1301 which engages into a cam slot profile 1304 provided at the lock plate 1302. The lock plate 1302 has two protruding lock forms 1310 and 1320. The protruding lock form 1310 is configured such that it can engage into a matching recess 1311 provided at the first end 212 of the first back support 211, when the lock plate 1302 is moved in the rearward direction. The protruding lock form 1320 is configured such that it can engage into a matching recess 1321 provided at the first end 222 of the second back support 221, when the lock plate 1302 is moved in the rearward direction. When the lock form 1310 is engaged into the recess 1311 and the lock form 1320 is engaged into the recess 1321, rotation of the back supports 211, 221 in the left-right direction is inhibited. Thus, when the lock plate 1302 is moved in the rearward direction, the locking mechanism 1300 is in the locked state. On the other hand, when the lock plate 1302 is moved in the forward direction, the lock forms 1310, 1320 are disengaged from the recesses 1311, 1321 such that the back supports 211, 221 can be rotated in the left-right direction and the locking mechanism 1300 is in the unlocked state.

Figure 14:
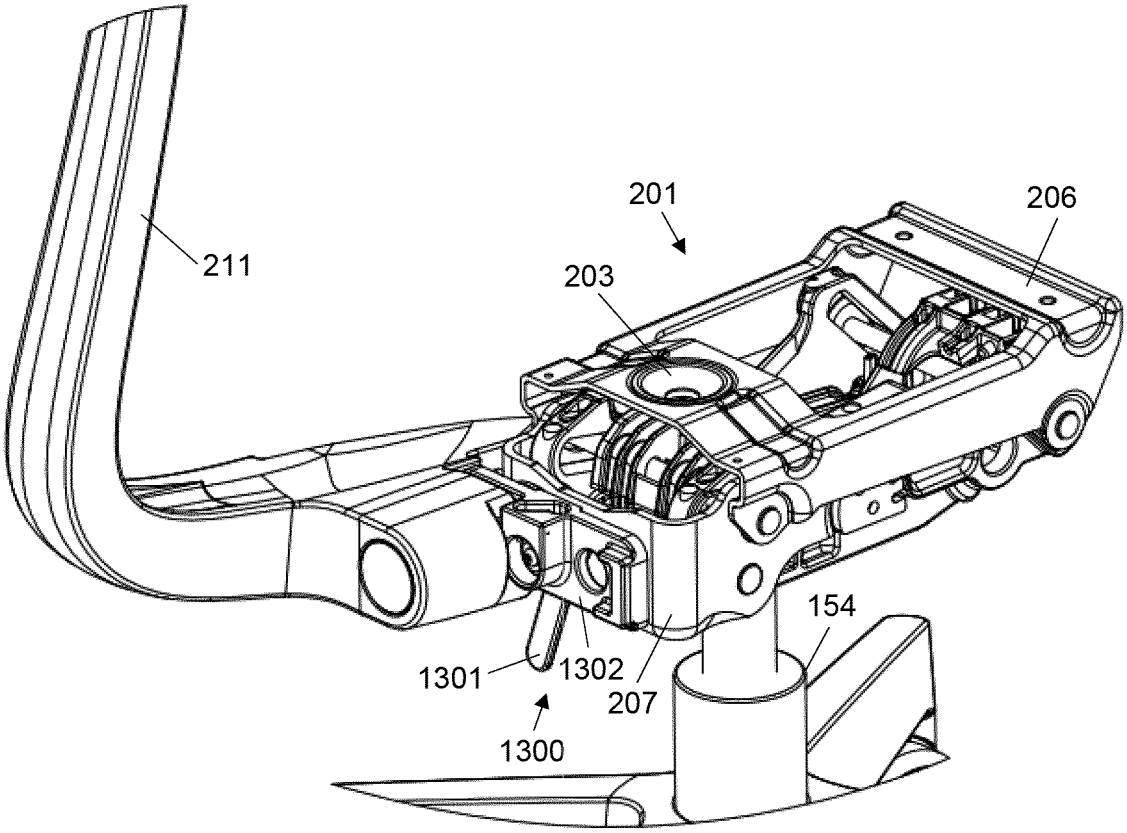
FIG. 14 is a schematic partial isometric view of the locking mechanism of FIG. 14.

FIG. 14 shows the locking mechanism 1300 of FIG. 13 in an assembled state, wherein in FIG. 14 the back support 221 is not shown for reasons of clarity.

Figure 15:
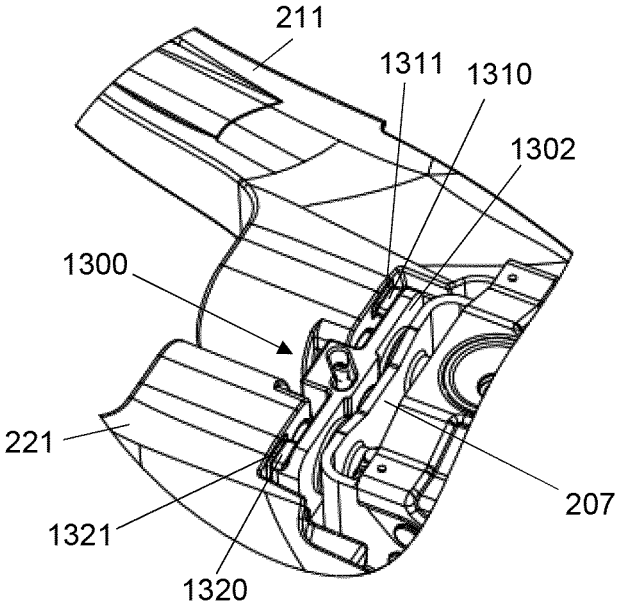
FIG. 15 is a schematic partial isometric view of the locking mechanism of FIG. 14 in an unlocked state.

FIG. 15 shows the locking mechanism 1300 in an enlarged view in the unlocked state. The lock plate 1302 is in a forward position, for example upon a movement in the forward direction caused by the lever 1301. In the forward position, the lock plate 1302 is spaced apart from the first ends 212, 222 of the first and second back supports 211, 221 and close to the back support plate 207. In this forward position, the protruding lock forms 1310 and 1320 are disengaged from the recesses 1311, 1321 provided in the first and second back supports 211, 221, and the first and second back supports 211, 221 can be rotated in the left-right direction 105 around the axis of rotation provided by the first and second rotary connections 214, 224.

Figure 16:
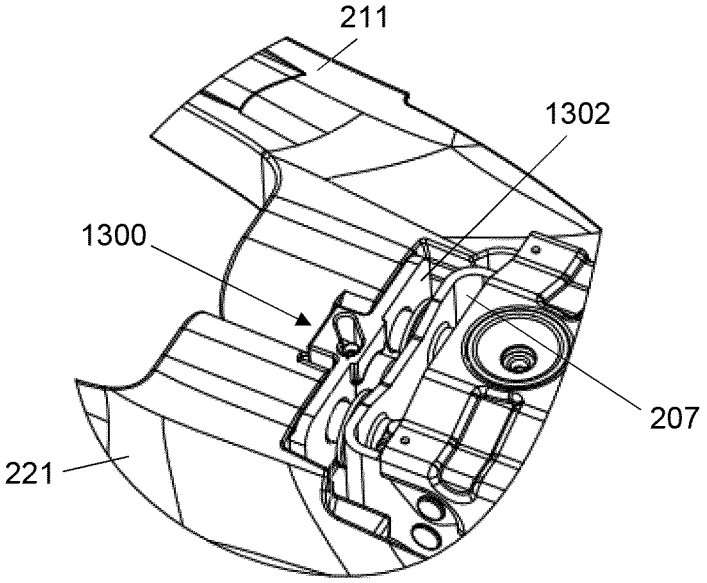
FIG. 16 is a schematic partial isometric view of the locking mechanism of FIG. 14 in a locked state.

FIG. 16 shows the locking mechanism 1300 in an enlarged view in the locked state. The lock plate 1302 is in a rearward position, for example upon a movement in the rearward direction caused by the lever 1301. In the rearward position, the lock plate 1302 is close to or in contact with the first ends 212, 222 of the first and second back supports 211, 221 and spaced from the back support plate 207. In this rearward position, although not visible in FIG. 16, the protruding lock forms 1310 and 1320 are engaged with the recesses 1311 and 1321 provided in the first and second back supports 211, 221. As a result, a rotation of the first and second back supports 211, 221 in the left-right direction 101 is blocked.

While exemplary embodiments have been described in the context of office-type chairs, the tilt mechanism 100 and the chair 101 according to embodiments of the invention are not limited to this particular application. Rather, embodiments of the invention may be employed to effect a coordinated motion of a chair back and the chair seat in a wide variety of chairs.

The invention claimed is:

1. A motion mechanism for a chair, the motion mechanism being configured to effect a coordinated movement of a chair seat and chair back of the chair, wherein a seating surface of the chair seat extends essentially in a front-rear direction and a left-right direction of the chair, wherein the chair back is arranged at a rear side of the chair seat, the motion mechanism comprising:

a mechanism configured to support the chair seat and to couple the chair seat to a chair base assembly;

a spherical joint configured for coupling the chair seat and the mechanism at a central position in the left-right direction of the mechanism and the chair seat;

a first back support configured to couple the chair back to the mechanism, wherein a first end of the first back support is coupled via a first rotary connection to the mechanism, wherein a second end of the first back support is configured for coupling to the chair back; and a second back support configured to couple the chair back to the mechanism, wherein a first end of the second back support is coupled via a second rotary connection to the mechanism, wherein a second end of the second back support is configured for coupling to the chair back;

wherein an axis of rotation of the first rotary connection extends in the front-rear direction and an axis of rotation of the second rotary connection extends in the front-rear direction, and wherein the second end of the first back support comprises a first flexible connection for coupling to the chair back, and wherein the second end of the second back support comprises a second flexible connection for coupling to the chair back.

2. The motion mechanism of claim 1, wherein a back surface of the chair back essentially extends in the left-right direction and an up-down direction perpendicular to the seating surface, wherein the first flexible connection comprises a first elastic element configured to enable an elastic movement of the back surface of the chair back with respect to the second end of the first back support in the up-down direction, and wherein the second flexible connection comprises a second elastic element configured to enable an elastic movement of the back surface of the chair back with respect to the second end of the second back support in the up-down direction.

3. The motion mechanism of claim 2, wherein the first flexible connection is arranged spaced from the second flexible connection in the left-right direction.

4. The motion mechanism of claim 1, wherein the first rotary connection is arranged spaced from the second rotary connection in the left-right direction.

5. The motion mechanism of claim 1, wherein the first rotary connection comprises a first pin extending in the front-rear direction, wherein a first end of the first pin is mounted at the mechanism and a second end of the first pin is rotatably inserted in a hole in the first end of the first back support, wherein the second rotary connection comprises a second pin extending in the front-rear direction, wherein a first end of the second pin is mounted at the mechanism and a second end of the second pin is rotatably inserted in a hole in the first end of the second back support.

6. The motion mechanism of claim 1, wherein the first back support has an L-shape extending from the first end of the first back support to the second end of the first back support, and wherein the second back support has an L-shape extending from the first end of the second back support to the second end of the second back support.

7. The motion mechanism of claim 1, wherein the spherical joint is arranged, in the front-rear direction, between a center and the rear side of the chair seat.

8. A motion mechanism for a chair, the motion mechanism being configured to effect a coordinated movement of a chair seat and chair back of the chair, wherein a seating surface of the chair seat extends essentially in a front-rear direction and a left-right direction of the chair, wherein the chair back is arranged at a rear side of the chair seat, the motion mechanism comprising:

a mechanism configured to support the chair seat and to couple the chair seat to a chair base assembly;

a first back support configured to couple the chair back to the mechanism, wherein a first end of the first back support is coupled via a first rotary connection to the mechanism, wherein a second end of the first back support is configured for coupling to the chair back; and a second back support configured to couple the chair back to the mechanism, wherein a first end of the second back support is coupled via a second rotary connection to the mechanism, wherein a second end of the second back support is configured for coupling to the chair back;

a first sliding connection coupling the chair seat to the chair back, wherein the first sliding connection is arranged at a left side of the chair seat and chair back, and a second sliding connection coupling the chair seat to the chair back, wherein the second sliding connection is arranged at a right side of the chair seat and chair back;

wherein an axis of rotation of the first rotary connection extends in the front-rear direction and an axis of rotation of the second rotary connection extends in the front-rear direction, and wherein the second end of the first back support comprises a first flexible connection for coupling to the chair back, and wherein the second end of the second back support comprises a second flexible connection for coupling to the chair back.

9. The motion mechanism of claim 8, wherein the first sliding connection is configured to enable a coordinated sliding movement in the front-rear direction and an up-down direction perpendicular to the seating surface, and wherein the second sliding connection is configured to enable a coordinated sliding movement in the front-rear direction and the up-down direction.

10. The motion mechanism of claim 9, wherein the first sliding connection comprises a guiding slot extending in the front-rear and up-down directions and a first pin slidingly supported in the guiding slot, and wherein the second sliding connection comprises a guiding slot extending in the front-rear and up-down directions and a second pin slidingly supported in the guiding slot.

11. The motion mechanism of claim 10, further comprising a locking mechanism mounted at the mechanism and configured to engage with at least one of the first and second back supports for inhibiting a rotation of the at least one of the first and second back supports upon actuating the locking mechanism.

12. The motion mechanism of claim 11, wherein the locking mechanism comprises a lock plate movable in the front-rear direction, wherein the lock plate comprises a protruding lock form configured to engage into a corresponding recess provided in the at least one of the first and second back supports in a locked state of the locking mechanism, and to disengage from the corresponding recess in an unlocked state of the locking mechanism.

13. A chair, comprising:

a chair base assembly;

a chair seat;

a chair back; and a motion mechanism to support the chair seat and to couple the chair seat to the chair base assembly, the motion mechanism comprising a first back support configured to couple the chair back to the mechanism, wherein a first end of the first back support is coupled via a first rotary connection to the mechanism, wherein a second end of the first back support comprises a first sliding connection for coupling to the chair back; and a second back support configured to couple the chair back to the mechanism, wherein a first end of the second back support is coupled via a second rotary connection to the mechanism, wherein a second end of the second back support comprises a second sliding connection for coupling to the chair back;

wherein an axis of rotation of the first rotary connection extends in a front-rear direction and an axis of rotation of the second rotary connection extends in the front-rear direction;

wherein the motion mechanism is attached to the chair base assembly, the chair seat being attached to the mechanism of the motion mechanism, and the chair back being attached to the first and second back supports of the motion mechanism.

* * * * *